US006889588B1

(12) United States Patent
Jenkins

(10) Patent No.: US 6,889,588 B1
(45) Date of Patent: May 10, 2005

(54) COMPENSATING BLISTER DIE CUTTER APPARATUS

(76) Inventor: Henry H. Jenkins, 602 Parsons Dr., Medford, OR (US) 97501

( * ) Notice: Subject to any disclaimer, the term of this patent is extended or adjusted under 35 U.S.C. 154(b) by 205 days.

(21) Appl. No.: 09/580,411

(22) Filed: May 30, 2000

(51) Int. Cl.[7] ..... B26D 7/26

(52) U.S. Cl. ..... 83/691; 83/695; 83/698.91; 83/699.31; 83/699.51; 83/945; 76/107.8

(58) Field of Search ..... 83/55, 698.91, 83/699.31, 699.41, 699.51, 699.61, 690, 691, 914, 945, 698.51, 698.11, 509, 510, 511, 512, 640, 641; 76/107.8, 107.1

(56) References Cited

U.S. PATENT DOCUMENTS

| | | | | | |
|---|---|---|---|---|---|
| 2,313,801 | A | * | 3/1943 | Carll | 83/699.31 X |
| 2,619,897 | A | * | 12/1952 | St. Lawrence | 101/30 |
| 2,939,347 | A | * | 6/1960 | Tobey | 76/107.8 |
| 3,048,069 | A | * | 8/1962 | Berlin et al. | 83/123 |
| 3,752,042 | A | * | 8/1973 | Castille | 83/698.51 X |
| 5,515,749 | A | * | 5/1996 | Sandford | 76/107.8 X |

* cited by examiner

*Primary Examiner*—Clark F. Dexter
(74) *Attorney, Agent, or Firm*—Woodling, Krost & Rust

(57) ABSTRACT

A compensating blister die cutter apparatus is disclosed which has the purpose of cutting a sheet of blisters which have been formed on a sheet of plastic material in individual blisters which are generally symmetrical in configuration. The apparatus includes at least first and second blister die cutter units supported by a base member. Each of the blister die cutter units comprises a supporting member which includes a bottom board, a backup plate positioned on the bottom board, and a top board positioned on the backup plate. A rule slot is provided in the top board and a steel rule is located in the rule slot and has a cutting edge. A cavity is formed in the central portion of the bottom board, backup plate and top board as assembled to accommodate the blister shape during the cutting operation. A threaded member connects the bottom board, backup plate and top board together to move as a unit. Vertical holes extend through the connected bottom board, backup plate and top board and have a diameter of a given dimension through which adjustment members extend which are threaded into the base member. The adjustment members have a smaller diameter than the given dimension thus permitting lateral movement of the connected bottom board, backup plate and top board relative to said base member.

3 Claims, 8 Drawing Sheets

Fig. 5
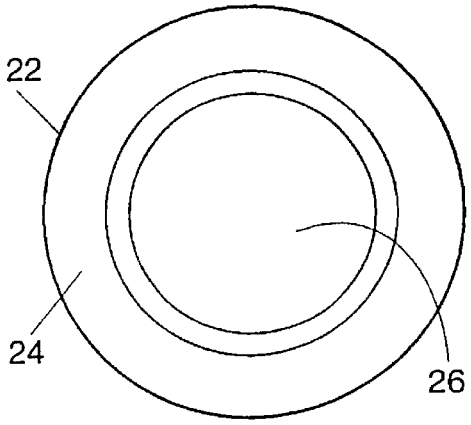
Fig. 7
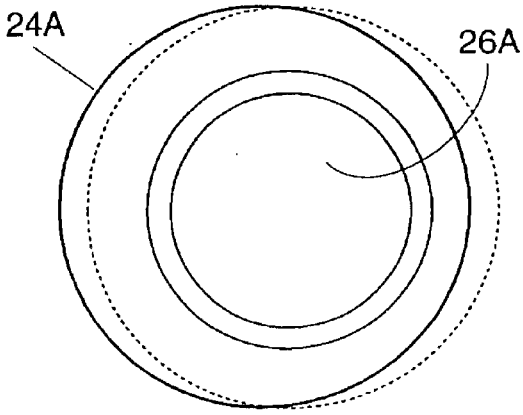
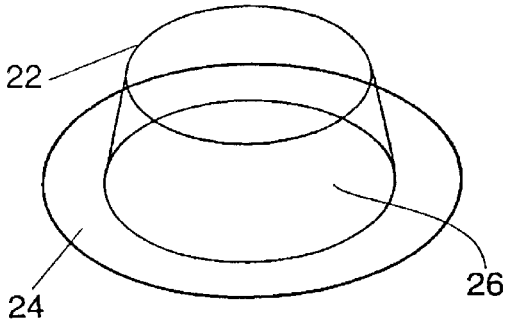
Fig. 4
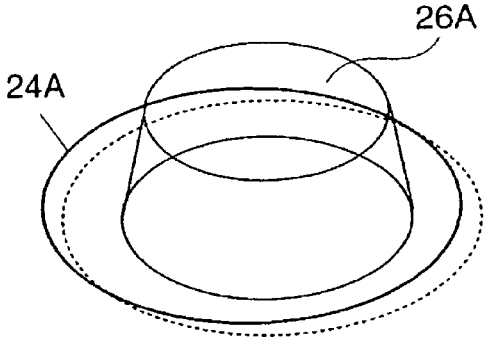
Fig. 6

COMPENSATING BLISTER DIE CUTTER APPARATUS

This invention relates to a die cutter apparatus for severing blisters into individual blisters from a sheet of blisters which has been formed from a deformable transparent or translucent sheet of plastic material by a process known to those skilled in the art.

Blisters which are used in the blister packaging art are conventionally formed from a large sheet of plastic material which is heated and formed around molds to produce a plurality of the blisters as part of an integral sheet of plastic material. Because of the nature of the plastic from which the blisters are formed there is a shrinkage of the sheet upon cooling and the amount of shrinkage is dependent upon the chemical nature of the plastic from which the blisters are formed and is also dependent upon other factors too numerous to mention herein. As a result of the shrinkage, the individual blisters will end up when the sheet is cooled at various distances from each other which is inconsistent as between blisters when they are originally formed about their respective molds. In other words, the finished blisters on the formed sheet, because of the shrinkage referred to above, will have distances from their respective centerlines which is different from the centerlines of the molds used to form the blisters. As a result when it is desired to cut the individual blisters from the integral sheet and since they are varying distances apart, the blister itself will be offset from the flange surrounding it.

SUMMARY OF THE INVENTION

The present invention contemplates the construction of a blister die cutter unit which accommodates a cutter for each blister formed on a sheet of plastic material with each blister die cutter unit being movable relative to the other so as to accommodate the shrinkage and relative movement of the blisters formed on the integral plastic sheet. This results in the provision that the rim or flange around each individual blister will be essentially concentric with the blister itself. This object of the invention will be observed with more particularity after an understanding of the structure and function which will be pointed out hereinafter.

Another object of the present invention is to produce a blister die cutter apparatus which is capable of cutting a plurality of blisters from an integral sheet on which the blisters are formed and producing an individual blister severed from the plastic sheet which is concentric with the rim or flange or ridge which is normally formed with each blister.

Another object of the invention is to provide a cutter apparatus which produces a blister which has a consistent flange about the severed blister which provides for a more reliable sealing function when it is subsequently sealed to a card which carries advertising indicia thereon and which carries the product within the blister.

Another object is to provide a blister die cutter apparatus which provides a finished blister which is more pleasing in appearance, more structurally sound and which functions to hold a product in a more reliable fashion to a card or substrate to which it is subsequently sealed.

BRIEF DESCRIPTION OF THE DRAWINGS

Other objects and a full understanding of this invention may be had by referring to the following description and claims, taken in conjunction with the accompanying drawings, in which:

FIG. 4 is an isometric view of a blister severed from the sheet of FIG. 1 with the blister die cutter apparatus of the present invention;

FIG. 5 is a plan view of the blister of FIG. 4;

FIGS. 6 and 7 are views similar to FIGS. 4 and 5 but illustrating the defects that may occur in conventional blisters produced with conventional cutting apparatus;

DETAILED DESCRIPTION OF THE PREFERRED EMBODIMENT

Figure 8:
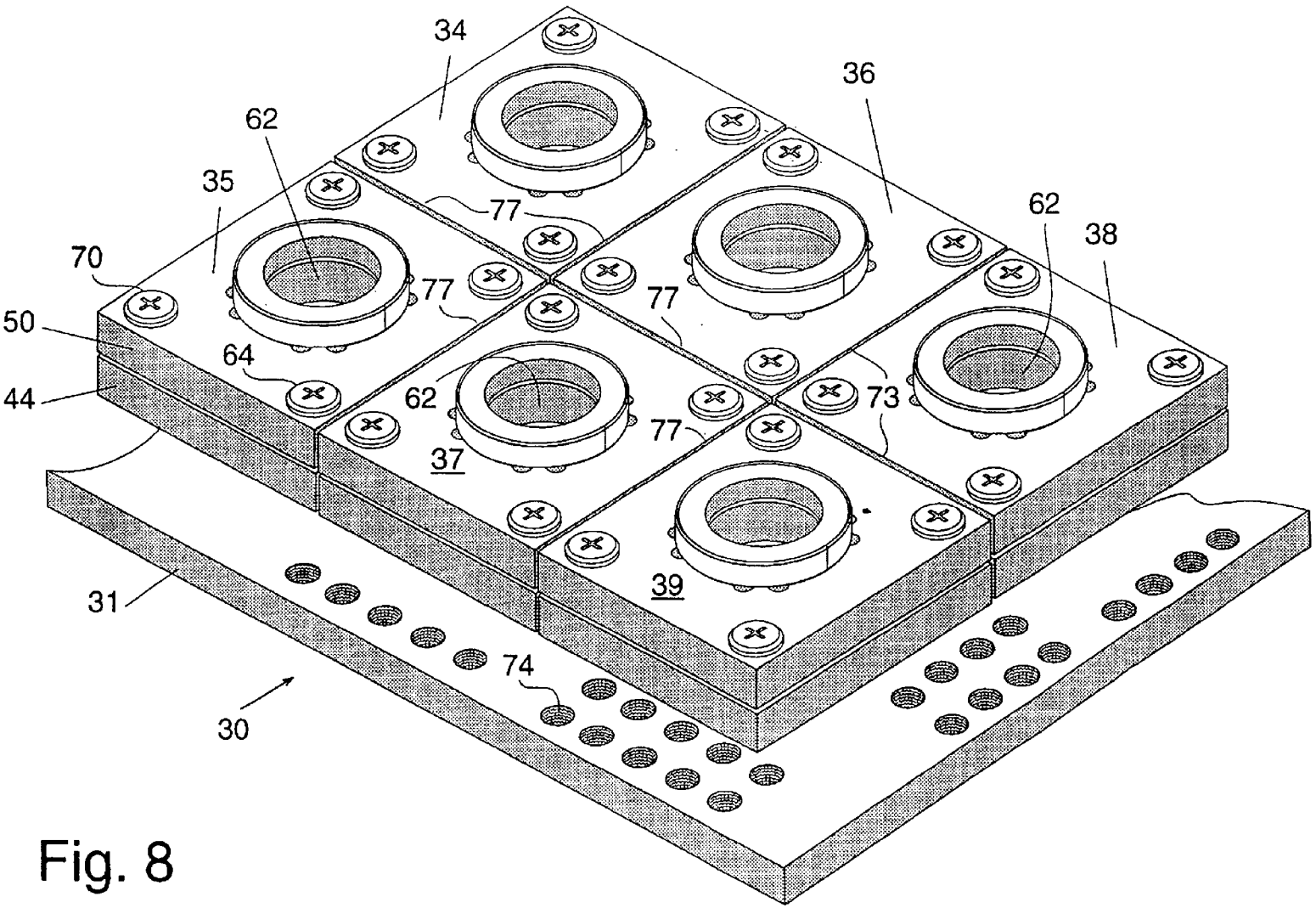
FIG. 8 is an isometric view of the compensating blister die cutter apparatus of the present invention illustrating individual blister die cutter units (for example shown here as six in number being equally spaced from each other)
Figure 9:
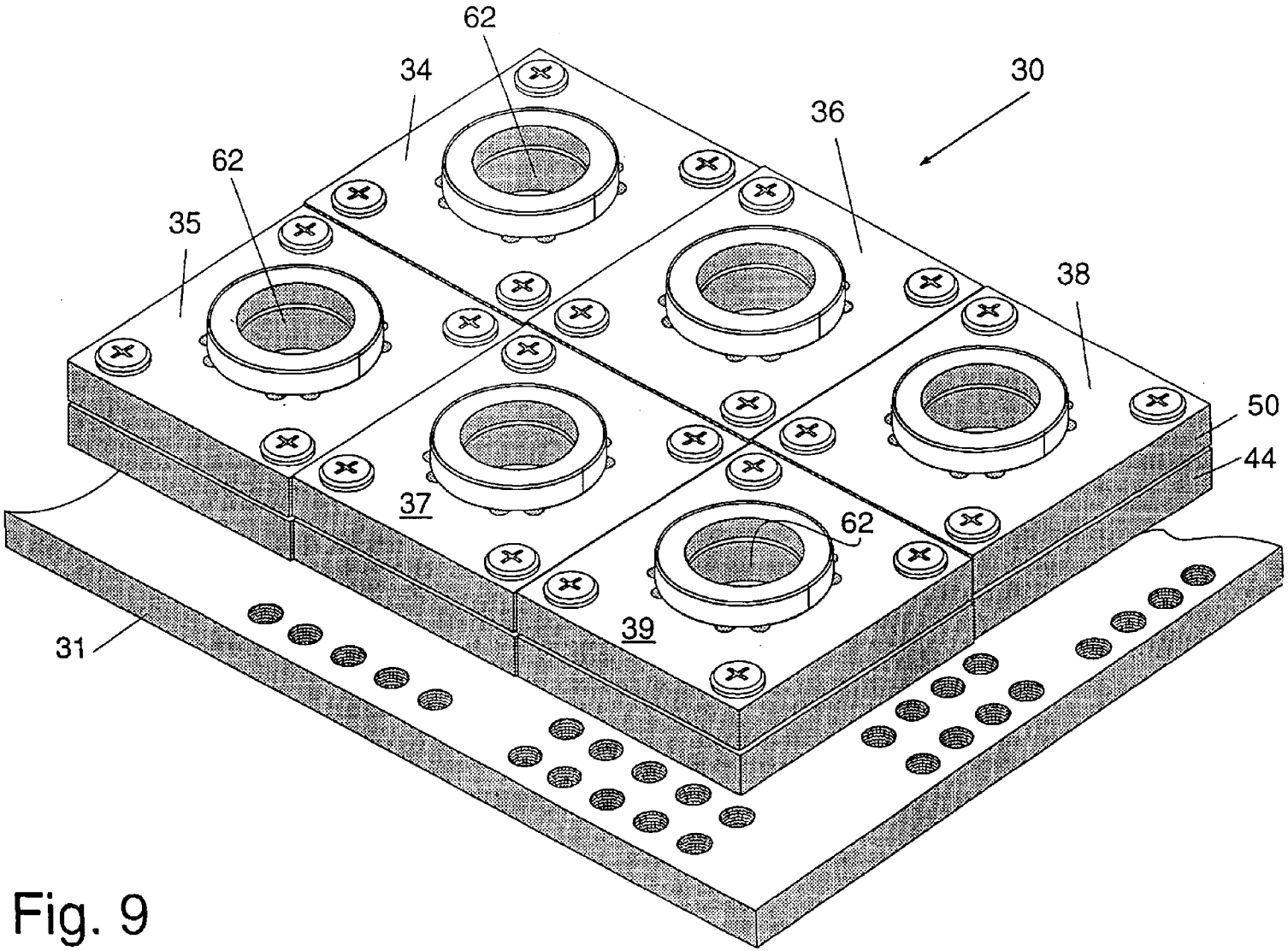
FIG. 9 is an isometric view similar to FIG. 8 showing the individual blister die cutter units being slightly shifted with respect to each other illustrating how the die cutter apparatus accommodates for the shrinkage and relative movement of the blisters produced on a sheet of plastic material after the blisters are formed.
Figure 10:
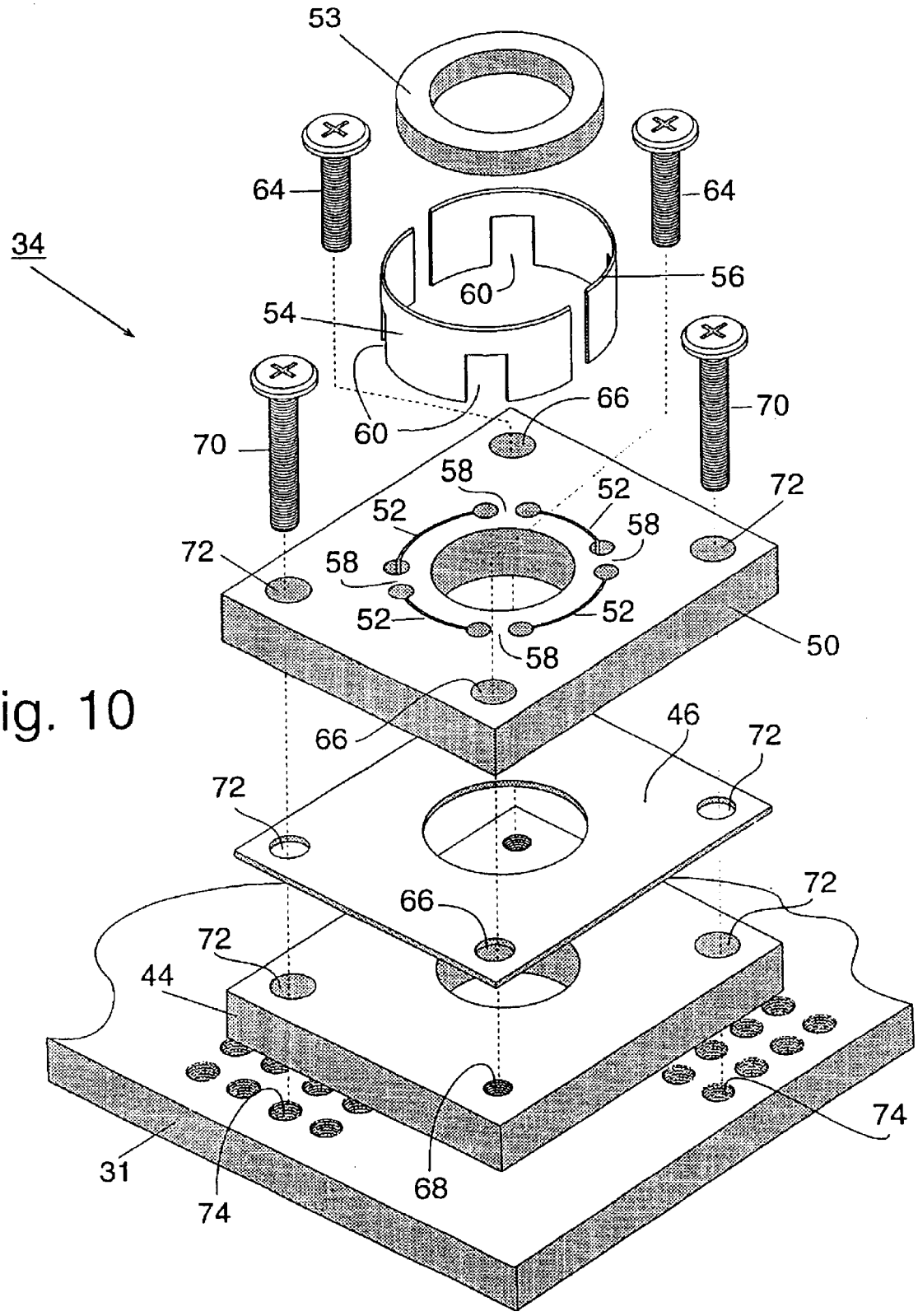
FIG. 10 is an exploded isometric view of an individual blister die cutter unit illustrated in FIGS. 8 and 9.

The drawings illustrate the compensating die cutter apparatus of the present invention illustrated generally by the reference numeral 30 and which is seen in various of the views including FIGS. 8 and 9 with the apparatus 30 being made up of (in the illustrated embodiment) six individual blister die cutter units identified by the reference numerals 34, 35, 36, 37, 38 and 39.

Figure 1:
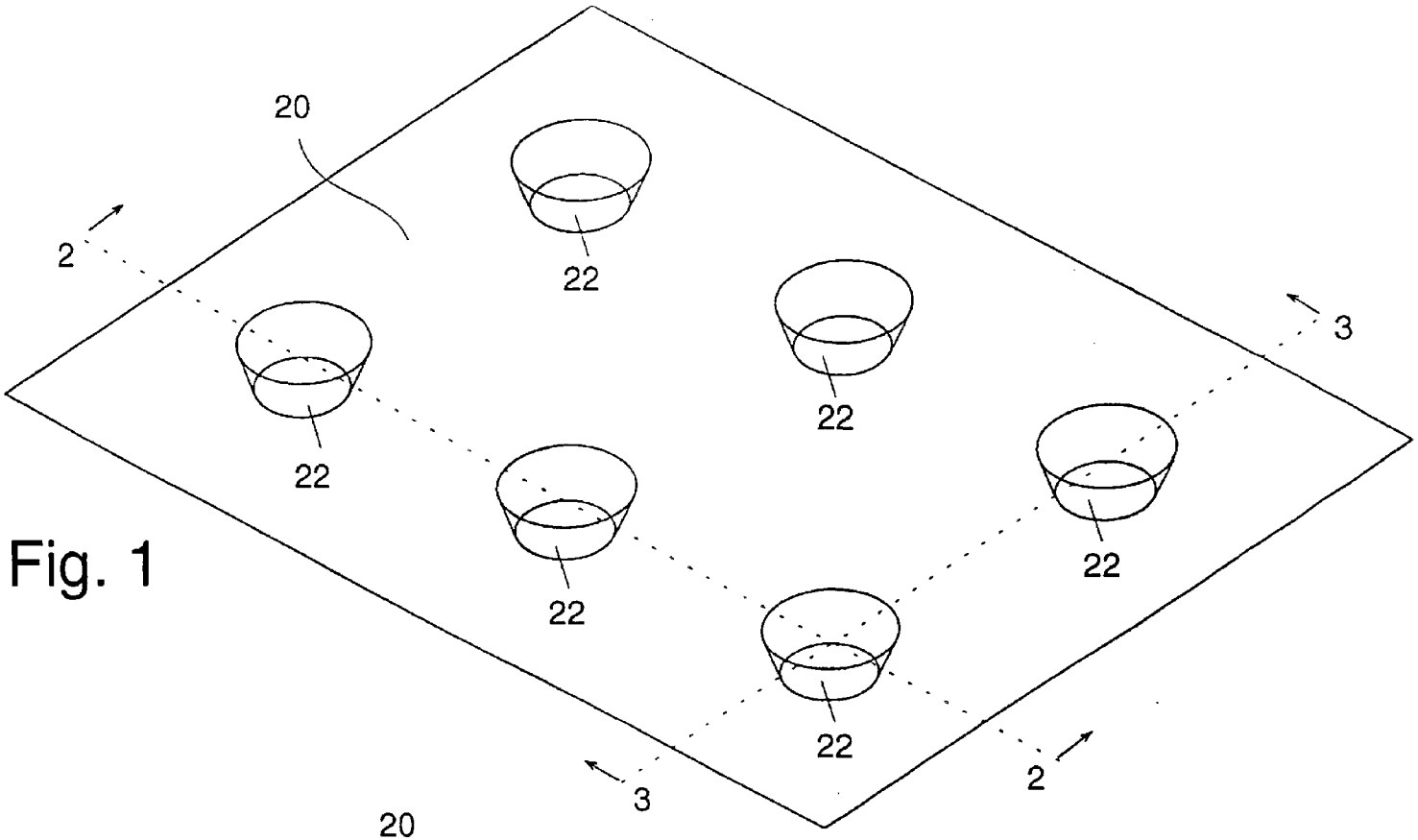
FIG. 1 is an isometric view of a plastic sheet which has been formed into a plurality of blisters in this illustrative embodiment the blisters being six in number.
Figure 2:
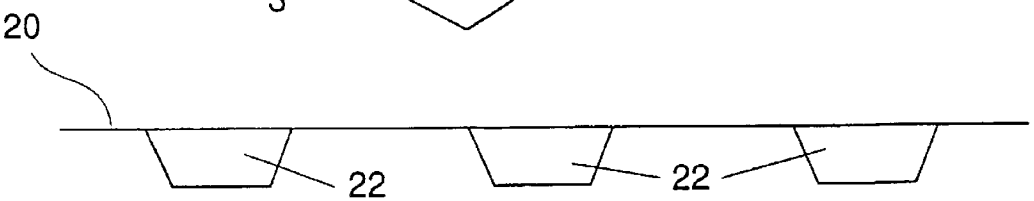
FIG. 2 is a view taken generally along the line 2—2 of FIG. 1.
Figure 3:
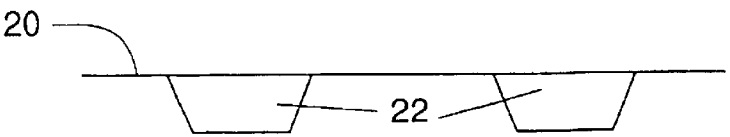
FIG. 3 is a view taken generally along the line 3—3 of FIG. 1.

The problem which the present invention is designed to solve comes from the nature of the sheets of plastic material illustrated at 20 in FIGS. 1–3 from which individual blisters are formed. The blisters in FIGS. 1, 2 and 3 are identified by the reference numeral 22.

As is understood in the blister packaging industry, it is normal to form a plurality of blisters 22 on and from a sheet of polymeric material by forming a heated sheet of the polymeric material around individual molds which form the blisters 22. In this process the polymeric material is heated to a substantially high temperature, for example on the order of 400° F. which allows the sheet 20 to more easily form over the individual molds and with the assistance normally of a vacuum the individual blisters 22 are formed. The sheet is then cooled and removed from the individual dies resulting in a sheet like that shown in FIG. 1. In the cooling process, a given batch of polymeric sheet material will shrink as it is cooled and will shrink irregularly. This results in the distance from individual center lines of the individual blisters being inconsistent. In most instances after a first group of blisters have been produced from a given batch of the polymeric sheet, the individual shrinkage will be somewhat consistent for subsequent sheets. When a manufacturer next goes to another batch of polymeric material the shrinkage will again, in most cases, be different and as usual inconsistent.

In the use of the blister die cutter apparatus of the present invention and for the reasons given hereinafter, it has been found that when the plurality of blisters 22 carried by the sheet 20 are cut by the present invention, blisters are produced which approach the illustrations found in FIGS. 4 and 5. In the illustrations of FIGS. 4 and 5, the blisters 22 are provided or produced with a rim portion 24 which is relatively symmetrical with the top portion 26 of the blister. The reason that the desirable product of FIGS. 4 and 5 is produced is the construction which mounts the individual blister die cutter units 34–39 in a manner which enables each die cutter unit to move relative to each other one to accommodate for the shrinkage in the plastic sheet as described.

In previous and present date cutter mechanisms, the results that are produced are relatively inconsistent and are demonstrated in FIGS. 6 and 7. It will be noted that the rim portions designated in FIGS. 6 and 7 as 24A are off-center or unsymmetrical with respect to the top portions 26A. This is because the die cutter units are fixedly and immovably mounted and as a result simply cut the plastic at the position in which the die cutter units are positioned relative to each other.

Figure 12:
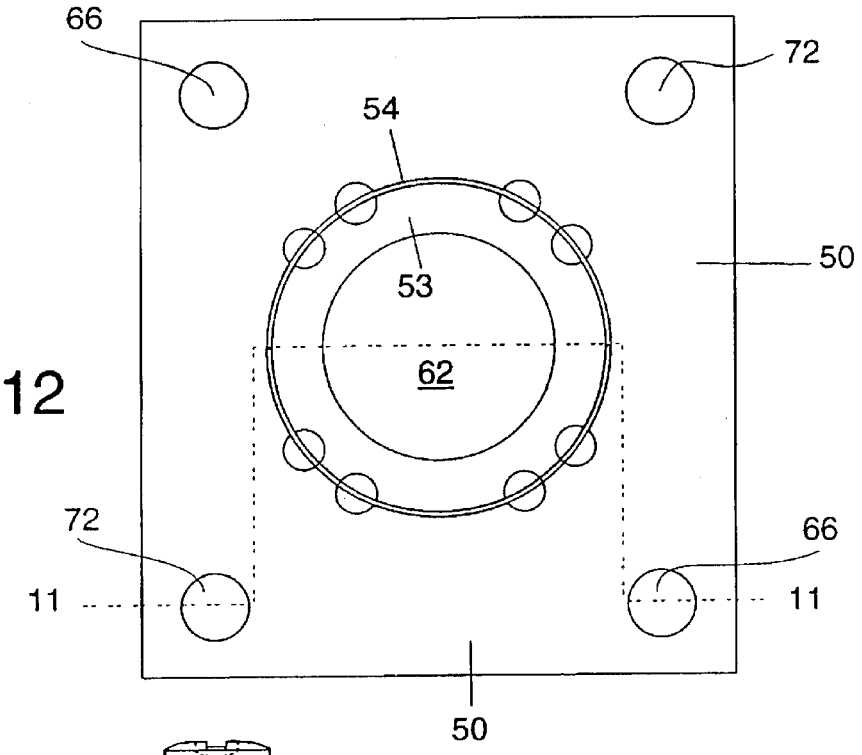
FIG. 12 is a plan view FIG. 11.
Figure 11:
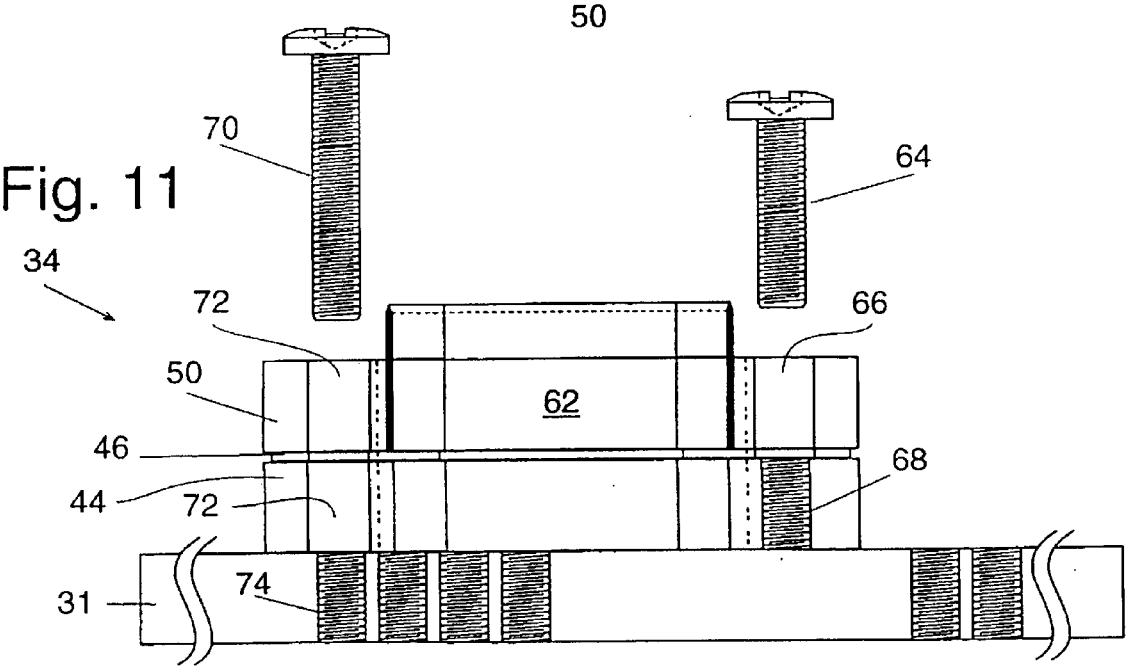
FIG. 11 is an elevational view of an individual blister die cutter of the apparatus taken generally along the line 11—11 of FIG. 12.
Figure 13:
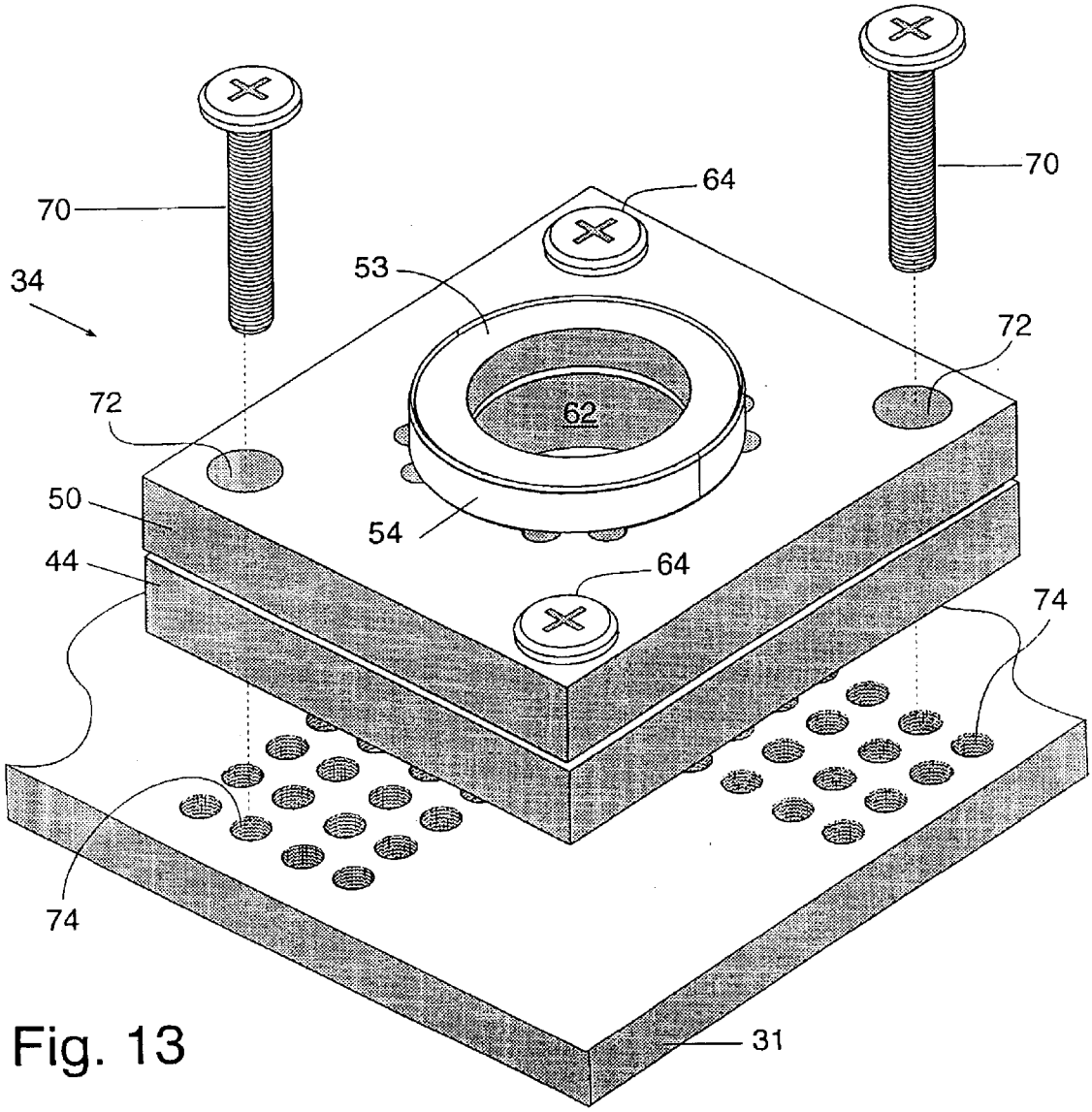
FIG. 13 is an isometric view of a partially assembled blister die cutter unit shown in FIGS. 10–12.

Each of the blister die cutter units 34–39 is illustrated in detail in FIGS. 10–14 and each includes a bottom board 44, a metal backup plate 46, and a top board 50. The boards are usually of a wood construction. The top board is provided with rule slots 52 in which is positioned a steel rule 54 to provide a cutting function by means of a cutting edge 56 formed thereon. The rule 54 in FIG. 10 has been shown discontinuous for illustrative purposes but is continuous as seen in FIGS. 12 and 13. The top board is provided with bridges 58 which serve to support the steel rule 54 within the rule slots 52 and keep the inside portion with the cavity in it from falling out. The rule has recesses 60 provided therein which closely straddle the bridges 58. Central holes in the top board, backup plate and bottom board form a cavity 62 to receive the individual blisters 22 during a cutting operation.

Threaded members 64 are provided and extend through holes 66 in the backup plate 46 and the top board 50 and are threadably received in threaded holes 68 in the bottom board 44 to hold the top board, backup plate and bottom board together fixedly as a unit.

Adjustment members 70 in the form of threaded members extend through holes 72 in the top board 50, backup plate 46 and bottom board 44 and threadably connect into threaded holes 74 in the base 31. The adjustment members 70 are fixedly secured in the base 31 and are of an outer diameter which is smaller than the diameter of the holes 72 in the top board, backup plate and bottom board. This permits the blister die cutter units to move relative to the base 31. The top board, backup plate, bottom board and associated structure comprise a support member and the member 70 of a smaller diameter than holes 72 amounts to a lost motion connection connecting the support member to the base 31.

The construction of each of the blister die cutter units 3439 as shown in FIGS. 8 and 9 is identical and each is mounted to the base 31 in the same fashion. FIG. 8 illustrates the blister die cutter units 34–39 mounted on the base with identical spacing between the edges of the units. This identical spacing has been indicated by the reference numeral 77.

Figure 14:
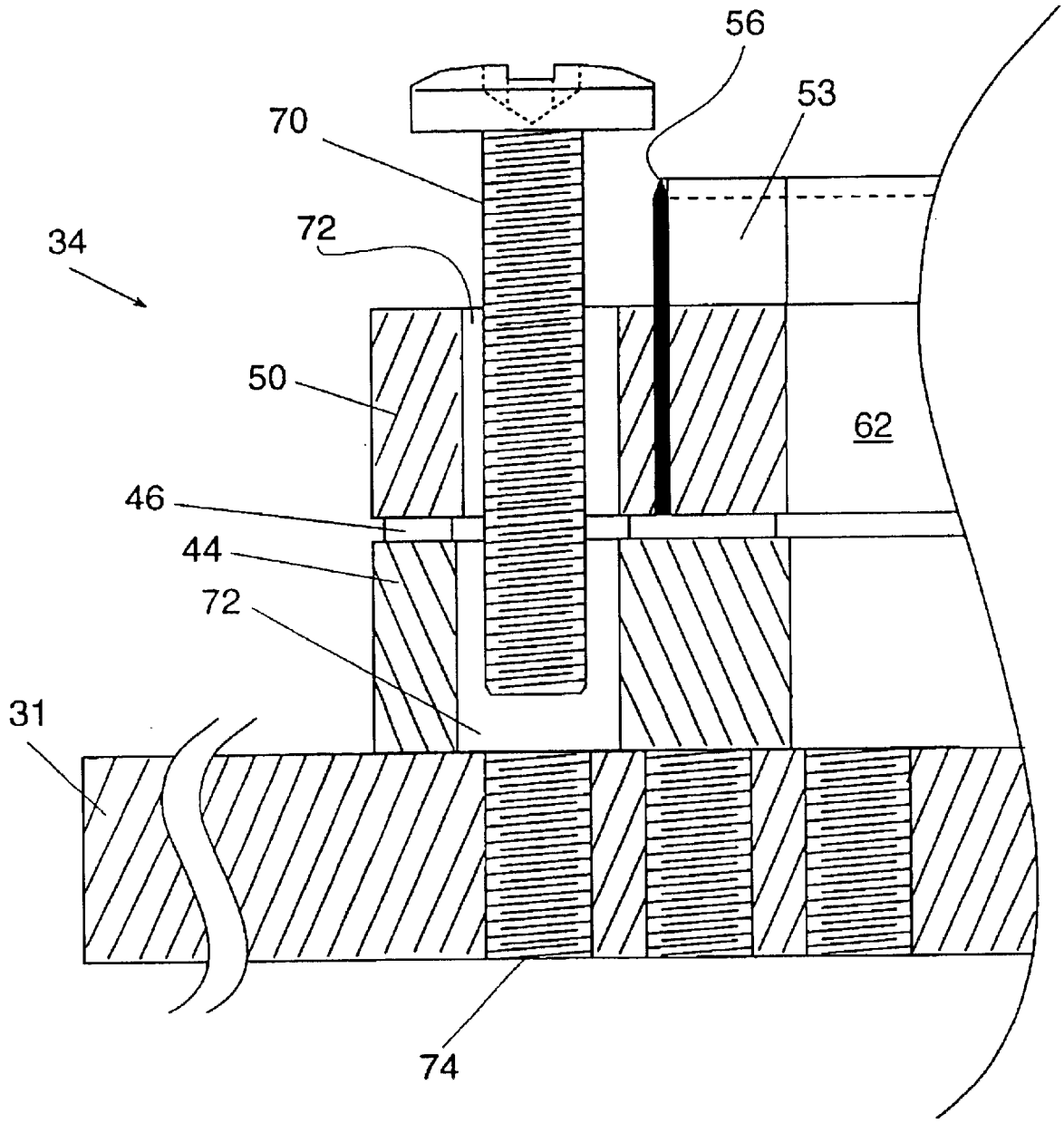
FIG. 14 is an enlarged fragmentary view taken in the same direction as FIG. 11 showing how the adjustment members fit through the holes in the cutter structure.

This spacing as a matter of example only maybe on the order of 1/16" to 1/8". FIG. 14 is an enlarged fragmentary view showing the members 70 and their position in openings 72 and as depicted in FIG. 8. In order that a die cutting operation be accomplished, the sheet 20 of blisters 22 as illustrated in FIG. 1 is brought into position in the FIG. 8 condition so that a given blister 22 fits into a given die cutter unit 34–39. Any shrinkage or movement of a blister 22 relative to another blister on the sheet 20 because of shrinkage is accommodated when a blister is pushed down into the cavity 62 of a given unit which causes that unit to shift so that a given blister fits into a given cavity in a symmetrical fashion. This causes the various die cutter units 34–39 to shift relative to each other as illustrated in FIG. 9 which positions each blister in a cavity of a given die cutter unit 34–39 in a symmetrical fashion so that a product like that illustrated in FIGS. 4 and 5 is produced when the cutting operation is effected.

The cutting operation is conventional in nature in that the apparatus as illustrated in FIGS. 8 and 9 is mounted on the platen of a die cutting mechanism and the platen is normally moved toward a planar surface. This causes the cutting edges 56 of the individual die cutter units to sever the blisters 22 from the sheet 20. When the operation is completed and the platen is moved away, the ejection rubber 53 of each unit 34–39 ejects the cut blisters from around the steel rules 54.

It will thus be seen that the present invention accomplishes the objects hereof in that the cutting units are constructed and mounted in such a fashion that they accommodate any possible and reasonable shrinkage of sheet 20 from which the blisters are formed thereby enabling the blisters 22 to symmetrically reside in the cavities of the units. The blisters are severed in such a fashion that a symmetrical rim 24 is produced on the blisters.

Although this invention has been described in its preferred form with a certain degree of particularity, it is understood that the present disclosure has been made only by way of example and that numerous changes in the detail of construction and the combination and arrangement of parts may be restored to without departing from the spirit and the scope of the invention as hereinafter claimed.

What is claimed is:

1. A compensating blister die cutter apparatus for cutting individual blisters from a sheet containing a plurality of blisters including a base member, at least first and second blister die cutter units supported by said base member, each said blister die cutter unit comprising a support member containing a cavity to receive a blister on the sheet and also carrying a steel rule die, a lost motion connection connecting said support member to said base member permitting relative lateral movement of each die cutter unit relative to said base member and relative to each other through a range of 360 degrees upon reception of the blister into and engagement with the cavity in the support members.

2. A compensating blister die cutter apparatus including a base member, at least first and second blister die cutter units supported by said base member, each said blister die cutter unit comprising a bottom board, a backup plate positioned on said bottom board, a top board positioned on said backup plate, a rule slot in said top board, a steel rule in said rule slot and having a cutting edge, a cavity formed in the central portion of said bottom board, backup plate and top board as assembled, threaded members connecting the bottom board, backup plate and top board together to move as a unit, vertical holes extending through the connected bottom board, backup plate and the top board and having a diameter of a given dimension, adjustment members extending through said vertical holes and being threaded into said base member, said adjustment members having a smaller diameter than said given dimension thus permitting lateral movement of said connected bottom board, backup plate and top board relative to said base member through a range of 360 degrees.

3. A compensating blister die cutter apparatus for cutting blisters from a sheet including a base member, at least first and second blister die cutter units supported by said base member, each said blister die cutter unit comprising a top board, a rule slot in said top board, a steel rule in said rule slot and having a cutting edge, a cavity formed in the central portion of said top board, vertical holes extending through said top board and having a diameter of a given dimension, an adjustment member extending through each of said vertical holes and being connected to said base member, and said adjustment members having a smaller diameter than said given dimension permitting movement of said blister die cutter unit relative to said base member through a range of 360 degrees upon reception of the blisters into and engagement with the cavities.

* * * * *